US010890378B2

(12) United States Patent
Davis

(10) Patent No.: US 10,890,378 B2
(45) Date of Patent: Jan. 12, 2021

(54) NEGATIVE PRESSURE DRYING APPARATUS

(71) Applicant: Chad K. Davis, Manhattan, MT (US)

(72) Inventor: Chad K. Davis, Manhattan, MT (US)

( * ) Notice: Subject to any disclaimer, the term of this patent is extended or adjusted under 35 U.S.C. 154(b) by 0 days.

(21) Appl. No.: 16/246,471

(22) Filed: Jan. 12, 2019

(65) Prior Publication Data

US 2020/0224969 A1 Jul. 16, 2020

(51) Int. Cl.
*F26B 5/04* (2006.01)
*F26B 25/16* (2006.01)
*F26B 9/08* (2006.01)

(52) U.S. Cl.
CPC ..... *F26B 5/04* (2013.01); *F26B 9/08* (2013.01); *F26B 25/16* (2013.01)

(58) Field of Classification Search
CPC ..... F26B 5/04; F26B 9/08; F26B 25/16
USPC ..... 34/92
See application file for complete search history.

(56) References Cited

U.S. PATENT DOCUMENTS 3,299,529 A * 1/1967 Roberts ..... A47L 23/205 34/104
3,402,480 A * 9/1968 Geitz ..... A24B 3/12 34/619
4,630,625 A * 12/1986 Capella ..... B05B 15/555 134/104.3
4,930,178 A * 6/1990 Monson ..... A47L 5/24 15/320
5,054,157 A * 10/1991 Werner ..... A47L 5/32 15/328
5,621,982 A * 4/1997 Yamashita ..... F26B 21/14 34/203
5,735,017 A * 4/1998 Barnes ..... A47L 7/0028 15/321
5,809,663 A 9/1998 Perque
7,458,130 B1 * 12/2008 Krymsky ..... A47L 5/14 15/345
8,196,310 B2 * 6/2012 McMahon ..... F26B 21/10 34/73
8,458,922 B2 * 6/2013 Parisi ..... F26B 3/28 34/92
9,121,128 B2 9/2015 Hong et al.
(Continued)

FOREIGN PATENT DOCUMENTS

GB 2361520 A * 10/2001 ..... F26B 5/04
WO WO-2004099692 A1 * 11/2004 ..... F26B 5/04

*Primary Examiner* — Stephen M Gravini
(74) *Attorney, Agent, or Firm* — Haffey Vap, PLLC; Mitchell Vap

(57) ABSTRACT

The herein described invention is a Negative Pressure Drying Apparatus. The preferred embodiment of the Negative Pressure Drying Apparatus is designed for drying saturated baseballs; however, the Negative Pressure Drying Apparatus could be used to dry most any article that would fit within the drying receptacle. The Negative Pressure uses mechanical means of moving air, generally an outward blowing fan mounted to a first end of a drying receptacle, which is comprised of a plurality of intake holes at a second end of the drying receptacle. The outward blowing fan creates negative pressure within the drying receptacle due to the output of the fan exceeding the intake of air through the intake holes. The negative pressure within the drying receptacle accelerates drying by drawing moisture out of the saturated articles.

5 Claims, 3 Drawing Sheets

(56) References Cited

U.S. PATENT DOCUMENTS

| | | | | |
|---|---|---|---|---|
| 9,186,802 | B2 * | 11/2015 | Parisi | B26B 19/3806 |
| 9,989,309 | B1 * | 6/2018 | Griffin | F26B 5/041 |
| 2007/0144036 | A1 | 6/2007 | Katefidis | |
| 2008/0134538 | A1 * | 6/2008 | McFarland | F26B 25/063 34/209 |
| 2009/0007367 | A1 * | 1/2009 | Archbold | A47L 5/365 15/327.1 |
| 2009/0094853 | A1 | 4/2009 | Noyes et al. | |
| 2015/0226481 | A1 * | 8/2015 | Marchiori | F26B 25/16 34/412 |
| 2016/0097592 | A1 * | 4/2016 | Crondahl | F26B 21/02 34/487 |
| 2017/0196425 | A1 * | 7/2017 | Brown | A47L 9/1683 |
| 2019/0110640 | A1 * | 4/2019 | Te Velde | F24C 15/327 |
| 2020/0224969 | A1 * | 7/2020 | Davis | F26B 9/08 |

* cited by examiner

NEGATIVE PRESSURE DRYING APPARATUS

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO SEQUENCE LISTING, A TABLE, OR A COMPUTER PROGRAM LISTING COMPACT DISC APPENDIX

Not applicable.

BACKGROUND OF THE INVENTION

The invention disclosed herein generally relates to a negative pressure drying apparatus. This invention provides a convenient means of drying saturated articles, without a heat source, and in a convenient receptacle, which can also be used to store the dried articles or be used to easily transport the dried articles.

There are many drying apparatuses described in the art. For example, U.S. Pat. No. 5,809,663 describes a portable, solar powered clothes dryer (hereafter "663"). The invention of the "663" patent is composed of a black colored housing to maximize heat energy to increase the temperature of the interior of the housing to aid in drying clothes. Furthermore, the invention of the "663" patent is composed of a solar power source to spin the clothes hamper. The invention of the "663" patent requires direct sunlight to operate. Thus, the "663" invention could not be used at night, in any area without direct sunlight, or during cloudy weather.

U.S. Patent Application Publication 2009/0094853 A1 (hereafter "853") discloses a process to dry grain and granular products by using horizontal cross-flow air movement from a central vertical tube within a grain bin. Such a process requires positive cross-flow air pressure from within the drying apparatus rather than negative pressure. Furthermore, the material to be dried in the bin must be transferred from the drying bin to another bin for storage or transportation.

Therefore, a need remains for a drying apparatus that does not utilize a heat source, which provides a convenient means of drying saturated articles in a convenient receptacle, where said receptacle can also be used to store the dried articles or be used to easily transport the dried articles without transferring the dried articles from the receptacle.

All patents, patent applications, provisional patent applications and publications referred to or cited herein, are incorporated by reference in their entirety to the extent they are not inconsistent with the teachings of the specification.

BRIEF SUMMARY OF THE INVENTION

The Negative Pressure Drying Apparatus described herein solves the problems of other drying apparatuses outlined above. The preferred embodiment of the Negative Pressure Drying Apparatus is designed for drying saturated baseballs; however, one skilled in the art would appreciate that the Negative Pressure Drying Apparatus described herein could be used to dry most any article that would fit within the drying receptacle. Furthermore, the Negative Pressure Drying Apparatus could be designed to accommodate receptacles of different sizes and shapes.

While playing baseball in damp and wet conditions, baseballs naturally absorb water. Baseballs are made of mostly natural products; wool bound, and leather wrapped. A regulation baseball should weigh between 5 and 5¼ ounces. It is not uncommon for a baseball to weigh 6+ ounces after use in wet conditions. If moisture is not removed from the baseball in a reasonable amount of time, the baseball will breakdown, become soft, and will be rendered useless.

Furthermore, any extra water weight retained by a baseball translates into increased strain on a player's arm while throwing. Such increased weight can be detrimental to a player's throwing technique, and potentially lead to injury. Pitchers, who may throw 50-100 pitches during the course of a practice or game could be especially susceptible to injury due to the increased arm strain caused by water logged baseballs.

Traditional means of drying a baseball is air drying in open, warm, daylight conditions. The drying time of a baseball by this method is dependent on temperature and relative humidity. Drying by this means can take up to 4 days, which often results in baseballs simply becoming saturated between uses, and never actually drying completely. Furthermore, daily, prolonged exposure to the sun can breakdown the natural materials of a baseball, thus reducing the longevity of the ball.

The Negative Pressure Drying Apparatus described herein uses mechanical means of moving air, generally an outward blowing fan mounted to a first end of a drying receptacle, which is comprised of a plurality of intake holes at a second end of the drying receptacle. The outward blowing fan creates negative pressure within the drying receptacle due to the output of the fan exceeding the intake of air through the intake holes. The negative pressure within the drying receptacle accelerates drying by drawing moisture out of a saturated baseball.

The preferred embodiment of the Negative Pressure Drying Apparatus described herein is comprised of an outward blowing fan mounted within an airtight lid of a standard 5-gallon bucket. A 5-gallon bucket is the preferred storage and transportation vessel of baseballs used during practice. As such, a coach could rotate use of the device with two receptacles so that one 5-gallon bucket of balls is drying for 24 hours, while another bucket is available for practice, which insures dry, regulation weight baseballs, even during multiple wet weather condition days. Furthermore, the Negative Pressure Drying Apparatus does not rely on a heat source, sunlight, or low humidity conditions. The device can be used in any storage shed, garage, etc. where baseballs would typically be stored.

Controlled testing of the preferred embodiment of the Negative Pressure Drying Apparatus demonstrates a much increased rate and more complete drying of baseballs compared to traditional open air drying. As shown in Table 1, exemplar baseballs lost 86.4% of their water weight after 7 hours and 100% after 24 hours. However, in open air drying, exemplar baseballs lost only 21.9% after 7 hours, and only 56.2% after 24 hours as shown in Table 2.

TABLE 1

| NEGATIVE PRESSURE DRYER | | | | | | | |
|---|---|---|---|---|---|---|---|
| | | | | 7 hour dry time | | 24 hour dry time | |
| Brand | Dry Wt. | Wet. Wt. | % moisture | Wt. | % moisture | Wt. | % moisture |
| 1. Rawlings | 5 | 5.1 | 2 | 5 | 0 | 5 | 0 |
| 2. Tag | 5.1 | 5.5 | 8 | 5.2 | 2 | 5.1 | 0 |
| 3. Rawlings | 5 | 5.1 | 2 | 5 | 0 | 5 | 0 |
| 4. Diamond | 5.2 | 5.9 | 14 | 5.3 | 2 | 5.2 | 0 |
| 5. Diamond | 5.2 | 5.7 | 10 | 5.3 | 2 | 5.2 | 0 |
| 6. Tag | 5 | 5.4 | 8 | 5 | 0 | 5 | 0 |
| Average | 5.083 | 5.45 | 7.33 | 5.133 | 1 | 5.083 | 0 |

TABLE 2

| OPEN AIR | | | | | | | |
|---|---|---|---|---|---|---|---|
| | | | | 7 hour dry time | | 24 hour dry time | |
| Brand | Dry Wt. | Wet. Wt. | % moisture | Wt. | % moisture | Wt. | % moisture |
| 1. Diamond Black | 5.1 | 5.6 | 10 | 5.4 | 6 | 5.3 | 3.9 |
| 2. Tag | 5 | 5.7 | 14 | 5.5 | 10 | 5.2 | 4 |
| 3. Rawlings | 5.1 | 5.3 | 4 | 5.3 | 4 | 5.3 | 3.9 |
| 4. Rawlings | 5.1 | 6.1 | 20 | 6 | 18 | 5.5 | 7.8 |
| 5. Tag | 5.1 | 5.5 | 8 | 5.4 | 6 | 5.3 | 3.9 |
| 6. Diamond | 5 | 5.4 | 8 | 5.3 | 6 | 5.2 | 4 |
| Average | 5.067 | 5.6 | 7.33 | 5.133 | 8.33 | 5.3 | 4.583 |

Testing was also performed under normal use conditions. Two dozen (24) baseballs of various condition and brands were submerged in water to simulate wet playing conditions. The baseballs were then placed in the Negative Pressure Drying Apparatus. Measurements were taken after 12 and 24-hours drying time. As shown in Table 3, the baseballs lost an average of 93.5% of their water weight after 12 hours of drying time. After 24 hours of drying time, the baseballs lost 100% of water weight and were back to their starting dry weight.

TABLE 3

| Two Dozen Test | | | | |
|---|---|---|---|---|
| Ball # | Dry Wt. | Wet Wt. | 12-hour Wt. | 24-hour Wt. |
| 1 | 5 | 5.2 | 5 | 5 |
| 2 | 5.3 | 6 | 5.4 | 5.3 |
| 3 | 5 | 5.3 | 5 | 5 |
| 4 | 5.4 | 6.2 | 5.5 | 5.4 |
| 5 | 5.1 | 5.8 | 5.2 | 5.1 |
| 6 | 5 | 5.4 | 5 | 5 |
| 7 | 5.1 | 5.5 | 5.1 | 5.1 |
| 8 | 5.2 | 5.6 | 5.2 | 5.2 |
| 9 | 5.2 | 5.8 | 5.2 | 5.2 |
| 10 | 5.2 | 5.5 | 5.2 | 5.2 |
| 11 | 5.1 | 5.2 | 5.1 | 5.1 |
| 12 | 5 | 5.6 | 5 | 5 |
| 13 | 5.1 | 5.7 | 5.1 | 5.1 |
| 14 | 5 | 5.6 | 5 | 5 |
| 15 | 5.1 | 5.7 | 5.1 | 5.1 |
| 16 | 5.1 | 5.5 | 5.1 | 5.1 |
| 17 | 5 | 5.4 | 5 | 5 |
| 18 | 5.2 | 6.3 | 5.3 | 5.2 |
| 19 | 5 | 5.3 | 5 | 5 |
| 20 | 5.1 | 5.4 | 5.1 | 5.1 |
| 21 | 5.2 | 5.8 | 5.3 | 5.2 |
| 22 | 5.1 | 5.5 | 5.2 | 5.1 |
| 23 | 5.1 | 5.2 | 5.2 | 5.1 |
| 24 | 5 | 5.5 | 5 | 5 |

TABLE 3-continued

| Two Dozen Test | | | | |
|---|---|---|---|---|
| Ball # | Dry Wt. | Wet Wt. | 12-hour Wt. | 24-hour Wt. |
| Average | 5.108 | 5.583 | 5.137 | 5.108 |

The herein described Negative Pressure Drying Apparatus is a novel and effective means of drying articles. The Negative Pressure Drying Apparatus does not utilize a heat source; provides a means of drying saturated articles in a convenient receptacle; and said receptacle can also be used to store the dried articles or be used to easily transport the dried articles without transferring the dried articles from the receptacle.

DETAILED DESCRIPTION OF THE INVENTION

Figure 1:
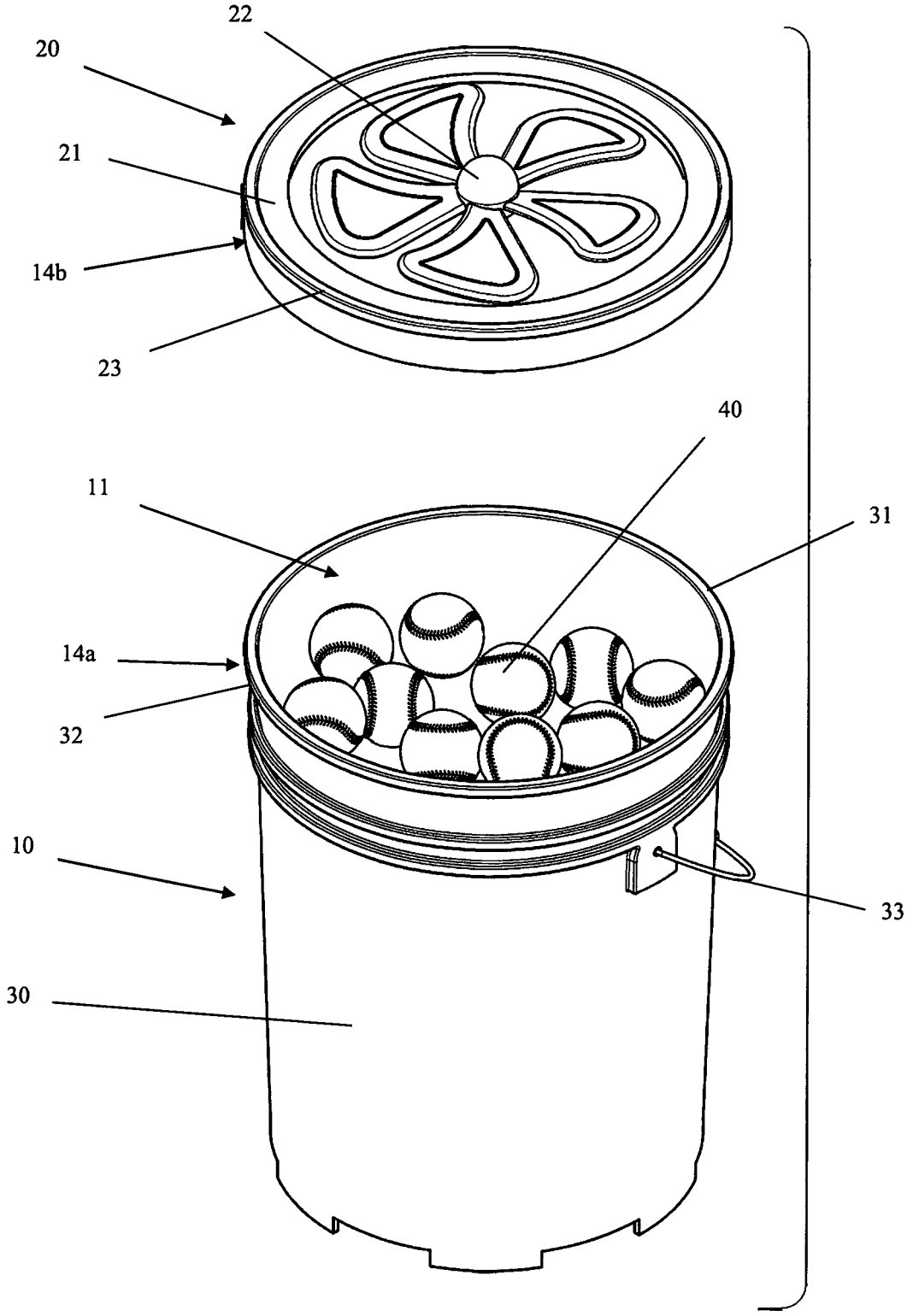
FIG. 1 is an elevated perspective view of the Negative Pressure Drying Apparatus showing the preferred embodiment of the invention.
Figure 2:
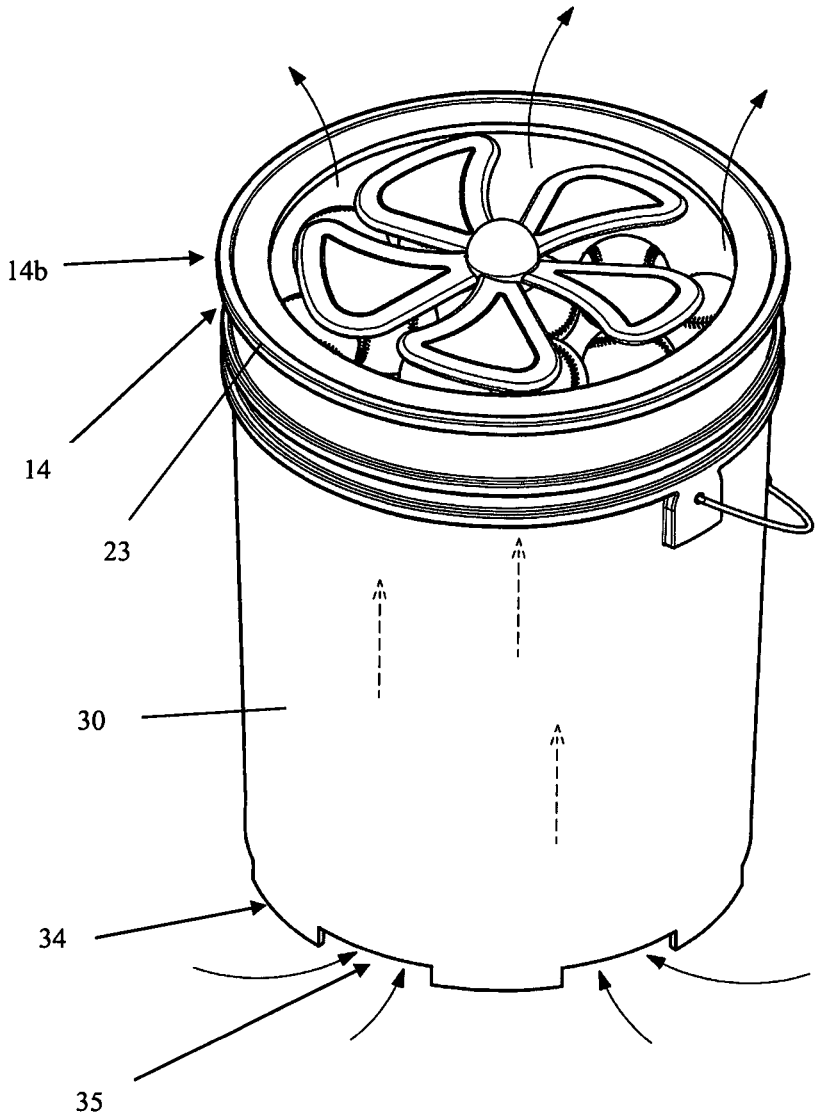
FIG. 2 is an elevated perspective view of the Negative Pressure Drying Apparatus demonstrating negative pressure airflow of the preferred embodiment.
Figure 3:
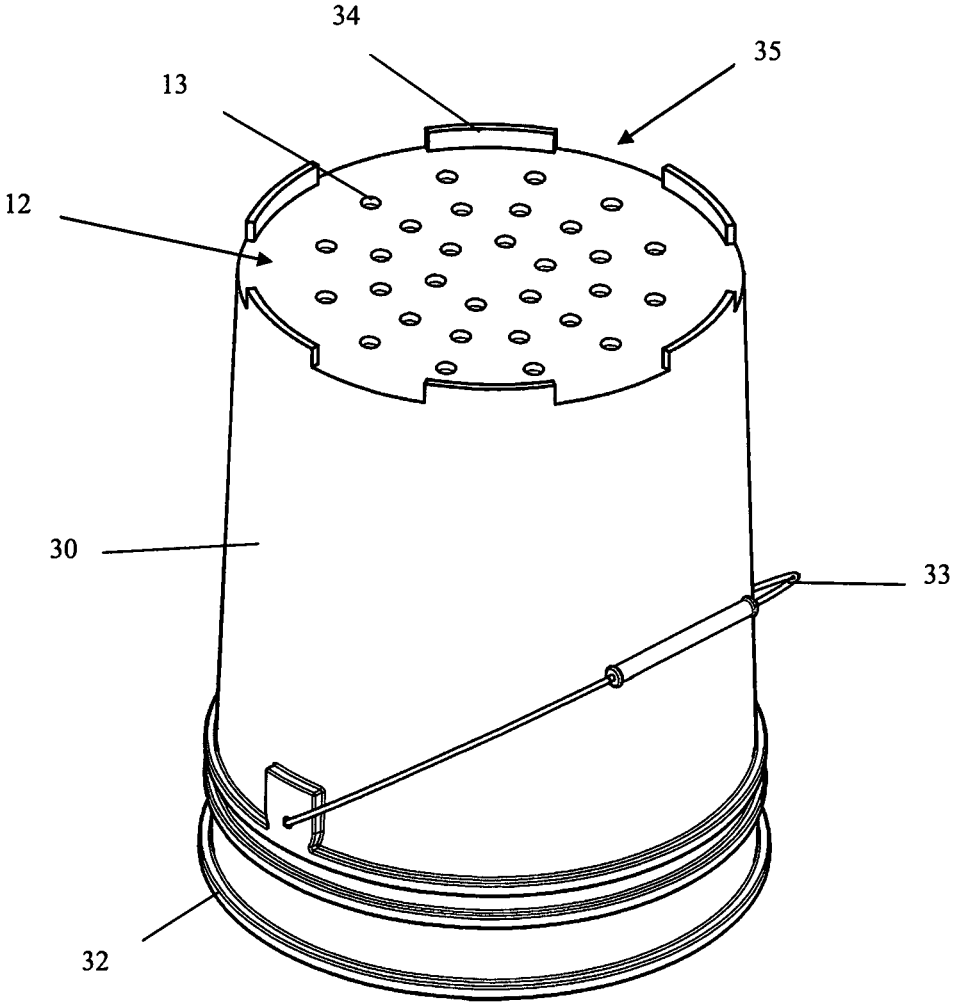
FIG. 3 is a perspective view of the closed end/bottom of the Negative Pressure Drying Apparatus demonstrating a plurality of air intake channels and holes of the preferred embodiment.

The Negative Pressure Drying Apparatus is comprised of a receptacle 10, which receives the articles 40 to be dried and means of air movement 20 to create negative pressure within said receptacle 10. Said receptacle 10 is further comprised of a first open end 11, through which the articles 40 for drying are loaded into said receptacle 10. Once the articles are loaded, said means of air movement 20 is then secured to the first open end 11 of the receptacle 10. The means of air movement 20 is secured to the first open end 11 by airtight sealable means 14. Said means of air movement 20 may also be comprised of a cover section 21 secured to said means of air movement 20 where said cover section 21 provides the means for securing said means of air movement 20 to said receptacle 10. The airtight sealable means 14 is comprised of a receptacle sealing means 14*a* and a corresponding cover section sealable means 14*b*. The receptacle is further comprised of a second closed end 12. Said closed end 12 is further comprised of a means of air intake. Generally, said means of air intake will be comprised of a plurality of air intake holes 13; however, one skilled in the art would recognize that air intake could also be accomplished by vents, slits, pipes, hoses, etc. The means of air movement 20 are secured to the first open end 11 in a manner so that air is forced outward from said first open end 11 as shown in FIG. 2. The rate of output of air created by the means of air movement 20 exceeds the rate of air intake through the intake holes 13, which creates a negative pressure within said receptacle 10.

In a preferred embodiment, said receptacle 10 is comprised of a bucket 30. The first open end 11 of the bucket 30 is further comprised of a rim 31 with a sealable ridge 32, which comprises the receptacle sealing means 14*a*. The bucket 30 is further comprised of a handle 33, which allows for easy transportation of the articles 40 within the bucket 30. The second closed end 12 of said bucket 30 is comprised of a plurality of supports 34, which suspend the second closed end 12 of the bucket off of the surface the bucket 30 is resting on. The second closed end 12 of the bucket 30 is further comprised of a plurality of air intake channels 35 between the plurality of supports 34, which allow air into the air intake holes 13 through the surface of the second closed end 12. While the preferred embodiment comprises a bucket, one with skill in the art would appreciate that the receptacle 10 could comprise other shapes and sizes depending on the type of articles to be dried.

In the preferred embodiment, said means of air movement 20 is comprised of an electric fan 22, which is mounted within the perimeter of said cover section 21. The perimeter of the cover section 21 is comprised of a sealing recess 23, which comprises the cover section sealable means 14*b* and corresponds with the sealable ridge 32 of the rim 31 of the bucket 30. In the preferred embodiment the cover section 21 and sealing recess 23 are sized to correspond to the sealable ridge of standard 5-gallon buckets. While the preferred embodiment comprises a cover section to correspond to the circular open end of a bucket, one with skill in the art would appreciate that the cover section could comprise any shape or size to correspond with receptacles of different shapes and sizes. Furthermore, one skilled in the art would appreciate that multiple airtight sealable means 14 could be utilized such as corresponding threads via a threaded receptacle sealing means 14*a* and corresponding threaded cover section sealable means 14*b*.

To utilize the preferred embodiment, the user loads the articles 40 to be dried into the bucket 30. Once loaded, the user then secures the cover section 21 with mounted electric fan 22 to the bucket 30 by engaging the sealable ridge 32 of the rim 31 of the bucket 30 with the sealing recess 23 of the cover section 21. Once fully engaged, the sealable ridge 32 and sealing recess 23 will create an airtight seal. The user then simply powers on the electric fan 22. The output of the electric fan 22 exceeds the air intake through the air intake holes 13 of the second closed end 12. As such, a negative pressure is created within the bucket 30, which draws moisture out of the articles 40 being dried. Moisture is exhausted out of the bucket by the air movement of the electric fan 22. Once the articles 40 are dried, the user can disengage the cover section 21 from the bucket 30. The articles can then be easily transported in the bucket by using the handle 33.

An important feature of the preferred embodiment is that the cover section 21 sealing recess 23 is sized to correspond to the sealable ridge of standard sized buckets such as 5-gallon, 6-gallon, etc. As such, the cover section 21 with electric fan 22 could be utilized with a user's pre-owned standard buckets with simple modifications.

It is understood that the foregoing examples are merely illustrative of the present invention. Certain modifications of the articles and/or methods may be made and still achieve the objectives of the invention. Such modifications are contemplated as within the scope of the claimed invention.

What is claimed is:

1. A Negative Pressure Drying Apparatus comprising:

a. a receptacle, which receives an article for drying, comprising a first open end, and a second closed end, where said first open end is comprised of a rim with a sealable ridge and said second closed end is comprised of a plurality of supports to suspend said receptacle off of a surface, where said plurality of supports allow air flow between said plurality of supports to a plurality of air intake holes of said second closed end;

b. a corresponding cover section of said first open end of said receptacle, comprising a fan mounted within a perimeter of said cover section, where said perimeter further comprises a sealing recess, which engages and disengages from said sealable ridge of said rim of said first open end of said receptacle;

c. wherein, said fan blows outward from said receptacle at a rate, which exceeds a rate of air intake through said air intake holes creating a negative pressure within said receptacle.

2. The Negative Pressure Drying Apparatus of claim 1, where said receptacle is comprised of a bucket.

3. The Negative Pressure Drying Apparatus of claim 1, where said receptacle is further comprised of a handle.

4. A Negative Pressure Drying Apparatus comprising:

a. an electric fan;

b. mounted within a perimeter of a lid corresponding to a first open end of a bucket, wherein said bucket receives an article for drying;

c. where the perimeter of said lid is further comprised of a sealing recess, which engages and disengages from a sealable ridge of said first open end of said bucket;

d. wherein, when engaged to said bucket, said fan blows outward from said bucket at a rate, which exceeds a rate of air intake of said bucket to create a negative pressure within said bucket.

5. The Negative Pressure Drying Apparatus of claim 4 where said bucket is comprised of a 5-gallon bucket.

* * * * *